United States Patent [19]

Marquardt

[11] 4,005,588

[45] Feb. 1, 1977

[54] SPRING BRACELET CONSTRUCTION USING SNAP-FITTED WINGS

[75] Inventor: Max Marquardt, West Warwick, R.I.

[73] Assignee: Marquardt-Hudes, Inc., Providence, R.I.

[22] Filed: Feb. 17, 1976

[21] Appl. No.: 658,848

[52] U.S. Cl. ..... 63/9

[51] Int. Cl.[2] ..... A44C 5/12

[58] Field of Search ..... 63/6, 7, 8, 9, 11; 224/4 K, 4 J

[56] References Cited

UNITED STATES PATENTS

| | | | |
|---|---|---|---|
| 290,590 | 12/1883 | Lettré | 63/9 |
| 293,016 | 2/1884 | Harrington | 63/9 |
| 1,971,094 | 8/1934 | Boots | 63/9 X |
| 2,513,892 | 7/1950 | Pile | 224/4 K |
| 2,996,899 | 8/1961 | Donle | 63/9 |

*Primary Examiner*—F. Barry Shay
*Attorney, Agent, or Firm*—Salter & Michaelson

[57] ABSTRACT

A bracelet having a pair of curved wing members pivotally connected by a hollow intermediate head. Tongues extend from the wing members into ends of the head and detents on the tongues are engaged by detents on spring means positioned within the head whereby the latter are snap-received by the former to interconnect the wing members and the head. The spring means has a body which is fitted within the head with spring extensions at its ends which normally bias the outer ends of the wing members to a relatively closed position while permitting spreading of said wing members to an open position.

10 Claims, 10 Drawing Figures

SPRING BRACELET CONSTRUCTION USING SNAP-FITTED WINGS

BACKGROUND OF THE INVENTION

Bracelet constructions wherein outwardly extending wing members are resiliently connected to an intermediate head member are known. Such constructions, however, generally utlize either coil-type spring means in association with a pintle construction, or rely on complex interconnection mechanisms when utilizing flat or leaf-type spring means. An example of the former-type construction is shown in U.S. Pat. No. 2,765,108 and the latter-type construction in U.S. Pat. No. 1,971,094.

These above constructions are both expensive and require complex assembly procedures. Also, although it is desirable to avoid coil springs since they tend to lose their resilience and usually require a separate spring for each wing, the use of flat leaf springs has also created problems, due to the necessity of properly positioning the spring, and due to the necessity of providing effective means for connecting the wings to the head. The need thus exists for a simple, low-cost, yet reliable bracelet head and wing construction which may be readily assembled and which affords the necessary resilient mounting between the wing and head elements to assure easy spreading or opening of the wings for removal or placement of the bracelet on one's wrist.

SUMMARY OF THE INVENTION

The present invention accomplishes these aims while avoiding the prior art shortcomings discussed, by the provision of a bracelet construction comprising a pair of body member-engaging wings and a hollow intermediate connecting head, wherein each of the wings has an outwardly extending tongue which in turn is provided with a recess formed on the underside thereof. These tongues are adapted to be received by openings at opposite ends of the head and are engageable in snap-fit interrelationship with leaf-spring extensions provided at opposite ends of a spring member mounted and positively positioned within the head member. Novel means in the form of laterally opposed and outwardly extending fingers, integrally carried by the spring, serve to position the spring member within the head.

Therefore, a primary object of the instant invention is to provide a bracelet-type construction which assures of placement and removal by the provision of relative resilience between the head and the wing members thereof through the incorporation of snap-fit, cooperating detent means on respective portions of outwardly extending wing tongues and leaf spring extensions.

Another object of the invention is the provision of a bracelet construction of the type indicted wherein the necessity for utilizing coil-spring constructions is eliminated.

A still further object of the present invention is the provision of a bracelet construction of the type under consideration wherein a generally flat, leaf-type spring member is utilized to provide the resilient connection between the wing and head elements thereof, and wherein such spring is of one-piece construction, thereby eliminating the need for complex assembly or attachment means.

Still another object of the present invention is the provision of a bracelet construction wherein the opposed wing members thereof are assembled into the connecting head member by a positive, snap-fit engagement so that the correct positioning and securement of such wings relative to the head is readily apparent during assembly by sound and feel.

Other objects, features and advantages of the invention will become apparent when the description thereof proceeds when considered in connection with the accompanying illustrative drawings.

DESCRIPTION OF THE DRAWING

In the drawing which illustrates the best mode presently contemplated for carrying out the present invention.

DESCRIPTION OF THE INVENTION

Figure 7:
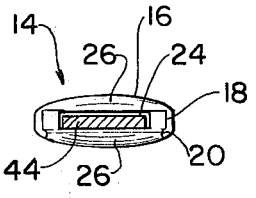
FIG. 7 is a sectional view taken along line 7—7 of FIG. 1.

Turning now to the drawing, a bracelet constructed in accordance with the instant invention is shown generally at 10 and includes a pair of body member-engaging wings 12 and a hollow intermediate connecting head 14. The head 14 includes a top plate 16, the sides of which are formed with flanges 18 which are turned inwardly at 20 to hold a bottom plate 22, which when positioned as shown constitutes the bottom of the head 14. The head 14 at each end thereof is further provided with openings 24 which are of a lateral extent somewhat less than that of the head as best seen by reference to FIG. 7 of the drawing.

The openings 24 are formed in an end wall 26 which is in turn preferably formed as a continuation of the top plate 16 and downwardly turned in the form of a flange to assist in securing the bottom plate 22 in position, whereby the head, with the exception of openings 24, constitutes a complete enclosure adapted to receive and house an elongated spring member 30.

The spring member 30 comprises an elongated flat body portion 32 having leaf extensions 34 outwardly extending at opposite ends thereof. Laterally spaced from the leaf extensions 34 and outwardly extending past the ends thereof are a pair of laterally opposed fingers 36. The fingers 36 are of such an extent that when the spring member 30 is positioned within the head, as best illustrated by FIG. 5 of the drawing, they are snugly positioned against the end walls 26 and the side flanges 18, and thus serve to position the spring members 32 and their outwardly extending leaf extensions 34 both longitudinally and laterally, so as to assure proper positioning thereof for receipt of the wings 12, as will hereinafter be more fully brought out.

Each of the leaf extensions 34 near the terminus thereof is provided with an upwardly extending detent 38 partially laterally extending across the extension and may be formed, as shown, by upwardly upset, opposed portions or lands 40. Each leaf extension 34 is also provided with a downwardly extending terminal portion 41 to better facilitate the entry of each wing 12 into the head, also as will be more evident as the description proceeds. The spring member 30 may be formed of suitable spring steel flat stock and may be formed to the shape illustrated, by known die-cutting and stamping techniques.

Each wing 12 consists of a relatively rigid, curved body, i.e., wrist-engaging section 42, having an integral outwardly extending tongue 44. The tongue is of a lateral extent so as to fit snugly within the opening 24 and of a thickness suitable to facilitate its entry into the interior of the head 14 to a position between the top plate 16 thereof and one of the spring extensions 34 whereby the tongue is automatically upwardly biased against the top plate 16 by means of the resilient upward urging of the spring member. In order to better facilitate such entry, the end portion of the tongue is upwardly chamfered as at 46 and is further provided on the under portion thereof with a recess 48 adatped for snap-fit engagement with the detent 38 of the leaf extension 34. Thus the wings may be easily and manually assembled to the head simply by inserting the tongues through the openings 24 and inwardly over the leaf extensions 34 until the detents 38 snap into the recesses 48, it being readily apparent, both by sound and feel, when the parts have snapped together.

Figure 1:
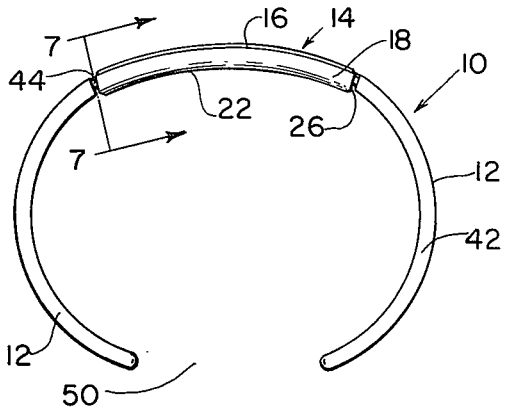
FIG. 1 is a top plan view of a bracelet constructed in accordance with the instant invention.
Figure 2:
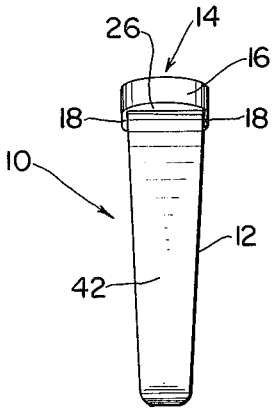
FIG. 2 is a side elevational view thereof.
Figure 3:
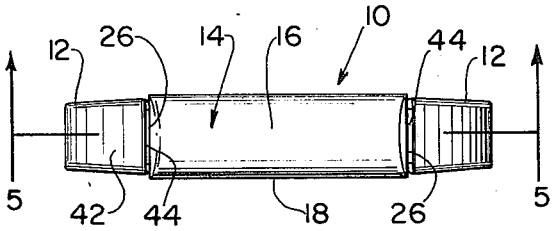
FIG. 3 is a front elevational view thereof.
Figure 4:
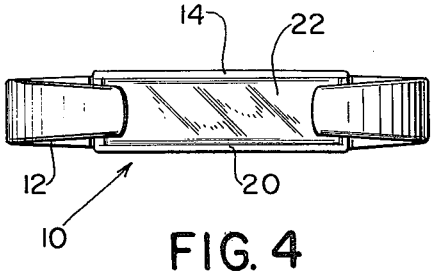
FIG. 4 is a rear elevational view thereof.
Figure 5:
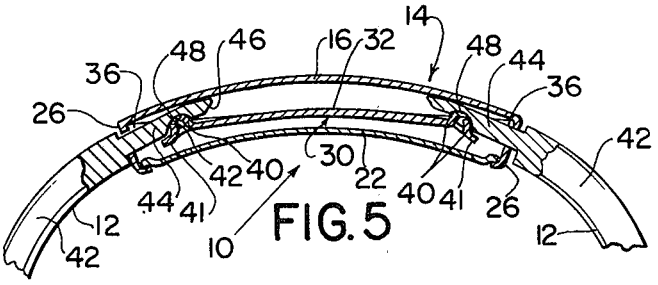
FIG. 5 is an enlarged fragmentary sectional view taken along line 5—5 of FIG. 3 showing the bracelet in its normally closed position.
Figure 6:
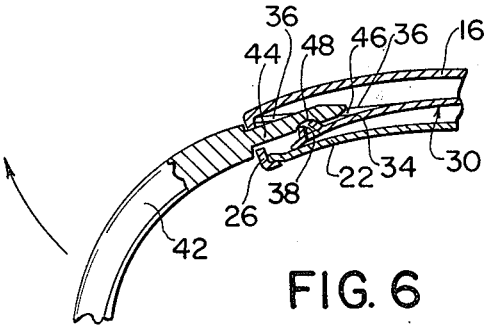
FIG. 6 is a fragmentary sectional view similar to that shown in FIG. 5 but showing one of the wing members in its open or spread position.

As previously indicated, and as best shown by FIG. 5 of the drawing, in normal position the wings 12 are biased inwardly towards each other to a relatively closed position by the upward urging of the leaf extensions 34 against the tongues 44, since such upward urging imparts a closing moment to the wings about their fulcrum points, i.e., the point where each tongue passes through its respective opening 24. However, when it is desired to spread or open the wings so as to enlarge the space 50 between the free ends thereof sufficiently to permit the bracelet to be mounted on or removed from one's wrist, it is simply necessary to spread or move the wings outwardly in the direction of the arrow illustrated in FIG. 6. In this position, the tongues have depressed the leaf extensions 34, it being understood that as soon as the outward pressure or force on the wings is released, they will automatically move back to the closed position of FIG. 5 pursuant to the urging of the spring 32, and more specifically, its leaf extensions 34.

Figure 10:
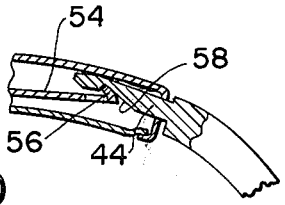
FIG. 10 is a fragmentary sectional view showing the interrelation between the spring of FIG. 9 and one of the tongue members.
Figure 8:
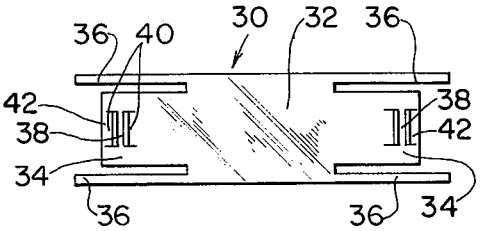
FIG. 8 is a top plan view of the spring member of the present invention.
Figure 9:
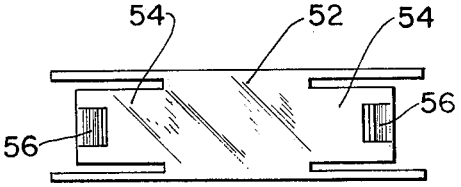
FIG. 9 is top plan view of a slightly modified form of spring member.

From the foregoing, it will be clear that the bracelet construction of the present invention provides a resilient, yet positive, connection between wing and head elements thereof, in such a manner that the wings may be conveniently and easily assembled and disassembled, since the shape of detents 38 and recesses 48 not only permits the wings to be snapped into position, but also permits the wings to be disassembled by an outward pull thereon of sufficient force. In some cases, however, it may be desirable to have an interconnection between the wings and the head which permits the aforesaid snap-in assembly, but which does not permit disassembly by an outward pull on the wings. In such a situation, a slightly modified spring 52 (FIG. 9) is employed, which spring differs from spring 32 only by virtue of the specific detent employed. More specifically, instead of utilizing a symmetrical detent 38, spring 52 is provided at the ends of its leaf extensions 54 with an integrally struck, upwardly and inwardly extending tang or barb 56 which is adapted to snap into recess 58 of tongue 44 (FIG. 10) but which, due to its configuration, cannot be pulled outwardly therefrom. Thus, once the parts shown in FIG. 10 have been assembled, they cannot be disassembled, except by disassembly of the head 14.

While there is shown and described herein certain specific structure embodying the invention, it will be manifest to those skilled in the art that various modifications of the parts may be made without departing from the spirit and scope of the underlying inventive concept and that the same is not limited to the particular forms herein shown and described except insofar as indicted by the scope of the appended claims.

What is claimed is:

1. A bracelet-type construction comprising a pair of wings of a size and shape to engage around a body member and a hollow intermediate connecting head, each of said wings having a tongue extending from one end, said head having an opening at either end thereof for receipt of said tongues, a spring member positioned within said head and having an upwardly biased leaf extension at either end thereof proximate said head openings, said tongues and said leaf extensions cooperatively provided with mutually engageable detent and recess means whereby said tongues and leaf extensions are snap-fit interengaged each other so as to retain said wings in assembled position with said head and to normally bias said wings towards each other to a relatively closed position at their ends remote from said head, said wings being separately outwardly movable against the force of said spring member to a relatively open position at said remote ends wherein said tongues downwardly depress said leaf extensions.

2. In the bracelet construction of claim 1, each of said tongues having a recess formed on the underside thereof and each of said leaf extensions having an upwardly extending detent.

3. In the bracelet-type construction of claim 1, said head being generally enclosed and having an upper surface against which said leaf extensions upwardly bias said tongues into contact therewith, said spring member having means to position such with respect to said head.

4. In the bracelet-type construction of claim 3, said spring member being of generally elongated flat construction having said leaf extensions of lesser width extending from opposite ends thereof and terminating short of said head end openings when positioned in said head.

5. In the bracelet-type construction of claim 4, said means to position said spring member comprising a pair of laterally opposed fingers on either side of said leaf extensions, said fingers extending longitudinally beyond said extensions and terminating adjacent opposite ends of said head.

6. In the bracelet-type construction of claim 5, lateral side portions of said fingers adapted for contact with the inner side walls of said head so as to laterally position said spring member within said head.

7. In the bracelet-type construction of claim 6, said leaf extensions being laterally spaced from said fingers whereby said leaf extensions are independently flexible both with respect to each other and said fingers.

8. In the bracelet-type construction of claim 3, each of said extensions having a downwardly tapered terminal portion and each of said tongues terminating in an upward taper, said respective tapers facilitating initial snap-fit engagement therebetween.

9. In the bracelet-type construction of claim 2, said detent being of symmetrical configuration whereby said tongues may be readily disassembled from said leaf extensions by pulling said wings outwardly from said head.

10. In the bracelet construction of claim 2, said detent comprising a barb extending upwardly and inwardly from a point adjacent the ends of said leaf extensions, said barbs permitting snap-fit assembly between said tongues and said leaf extensions, but preventing disassembly therebetween when an outward pulling force is imparted to said wings.

* * * * *